United States Patent [19]

Dixon

[11] Patent Number: 5,031,919

[45] Date of Patent: Jul. 16, 1991

[54] PORTABLE SKEE-BALL GAME

[76] Inventor: Donald Dixon, 1860 Elsie Dr., West Bloomfield, Mich. 48324

[21] Appl. No.: 617,665

[22] Filed: Nov. 23, 1990

[51] Int. Cl.[5] ..... A63F 7/02

[52] U.S. Cl. ..... 273/352

[58] Field of Search ..... 273/352

[56] References Cited

U.S. PATENT DOCUMENTS

| | | | |
|---|---|---|---|
| 1,221,803 | 4/1917 | Johnston | 273/352 |
| 1,531,880 | 3/1925 | Ritter | 273/352 |
| 2,724,594 | 11/1955 | Anderson | 273/352 |
| 2,806,701 | 9/1957 | Durant | 273/352 |

*Primary Examiner*—William H. Grieb

*Attorney, Agent, or Firm*—John J. Cantarella

[57] ABSTRACT

A portable version of the common Skee-Ball game which includes the improvements of: a ball return track which is non-dependant upon gravity for the return of the ball to the player of the game; a runner extending from the ramp to the play area of adjustable length; an electronic score recorder and score display; a ball stop for limiting the ball from leaving the ball return track and a ball return track which is adjustable in length.

14 Claims, 2 Drawing Sheets

22
22
20
26
86
10
32
38
5
86
2
34
40
36
22
22
24
18
28
28
10
16
16
12
30
14

PORTABLE SKEE-BALL GAME

BACKGROUND OF THE INVENTION

1. Field of the Invention

The present invention relates to games, and more particularly to an improved portable version of the commonly known Skee-Ball game in which a player rolls a ball along a relatively flat area toward an upwardly curving ramp, which if the balls are rolled with sufficient momentum, will cause the balls to become airborne, landing in a target area which is situated beyond the ramp area, the area struck by the ball determining a score, afterwhich the balls are returned along an inclined ball return track. The invention provides a portable version of the Skee-Ball game which is adjustable in length, is non-dependent upon gravity for the return of the balls to the players, provides both electronic score display and score storage and has other desirable features which will be revealed within this specification.

2. Description of the Relevant Art

Past versions of the common Skee-Ball game, both portable and fixed, are known but have limitations which the present invention eliminates.

Past and present versions of Skee-Ball, for example, have a ramp for rolling the ball toward the target area which is of a non-adjustable length. This lack of adjustability prevents users from enjoying an extended rolling area, which is highly desirable as it increases the skill required to be successful at the game, thereby increasing the competition between players of the game which is the desired result of games of this type.

A second limitation of known versions of Skee-Ball is the reliance upon gravity for the return of the balls to the players. This is often an undependable method of returning the balls as a level playing surface is required to maintain the pitch of the inclined ball return track.

A third limitation of known portable versions of Skee-Ball is that if a surface such as a table top is used as the ball rolling area the players must go to the target area to retrieve the balls and often the balls exit the target area in an uncontrolled fashion requiring players to chase balls which is both time consuming and disruptive to the playing of the game.

A fourth limitation of known portable versions of Skee-Ball is the lack of automatic ball throw counting which frequently is the issue of disagreements between players, often when one or more players leaves the playing area to retrieve a ball or balls.

Thus, a useful solution to the aforementioned problems, and other considerations not known to the applicant prior to his invention thereof would be a portable version of the Skee-Ball game which would have a ramp extension that is adjustable in length, an actively operating ball return mechanism connected to a flat ball return track that is adjustable in length to return the balls to the players without the need for leaving the playing area, a ball stop connected to the ball return track to eliminating the need to chase balls exiting the end of the ball return track, and an electronic circuit connected to an optical display and a plurality of sensors which would automatically count and display the number of balls thrown and the target area struck by the ball or balls thrown.

SUMMARY OF THE INVENTION

The present invention is for a version of the Skee-Ball game; the object of the present invention is to provide a portable version of the Skee-Ball game.

Another object of the present invention is to provide a ball return track which is not continuously inclined.

A further object of the present invention is to provide a ball rolling surface which would be extendable and adjustable in length, providing a smooth transition from the flat ball rolling surface to the ramp area.

An additional object of the present invention is to provide a ball return track which is adjustable in length.

Still another object of the present invention is to provide a ball stop to prevent balls from leaving the end of the ball return track closest to the players.

Yet another object of the present invention is to provide a means of automatically counting, and displaying optically, the number of balls thrown and the target areas which have been struck.

Yet another object is to provide a net to limit errantly thrown balls and redirect these balls to the ball return track.

Yet another object of the present invention is to provide a game as described within this specification which is simple in construction and use, and the materials of which it is made are durable, lightweight, stable, and inexpensive.

In accordance with the objectives of the present invention and the illustrated embodiment, the invention includes: a target area, supportive legs, to provide means, for maintaining the target area in an inclined position; a plurality of independent scoring areas operably engaged with the target area; a net operably engaged with the target area, to provide means for controlling errantly thrown balls; supportive posts operably engaged with the target area, to provide means for supporting the net at a predetermined angle and distance from the target area; first and second ball return tracks to return the balls to the players; a ball return chamber operably engaged with the target area to direct the balls thrown to the first ball return track; sensors operably engaged with the target area and first ball return track, to provide a means for sensing the target area, if any, struck by a ball; a motor operably engaged with the target member for returning the balls to the playing area; a hollow ramp; a flexible runner which provides a smooth ball rolling surface, the unused portion of which is stored within the hollow area of the ramp; an electrically operated optical numerical display for displaying the balls thrown and the target areas, if any, struck during play; an electrical circuit operably engaged with the sensors and the optical display; a source of electrical power operably engaged with the electrical circuit and the motor; and a ball stop operably engaged with the second ball return track, to provide means, for stopping returning balls at the end of the second ball return track closest to the players.

DETAILED DESCRIPTION OF THE PREFERRED EMBODIMENT

Figure 1:
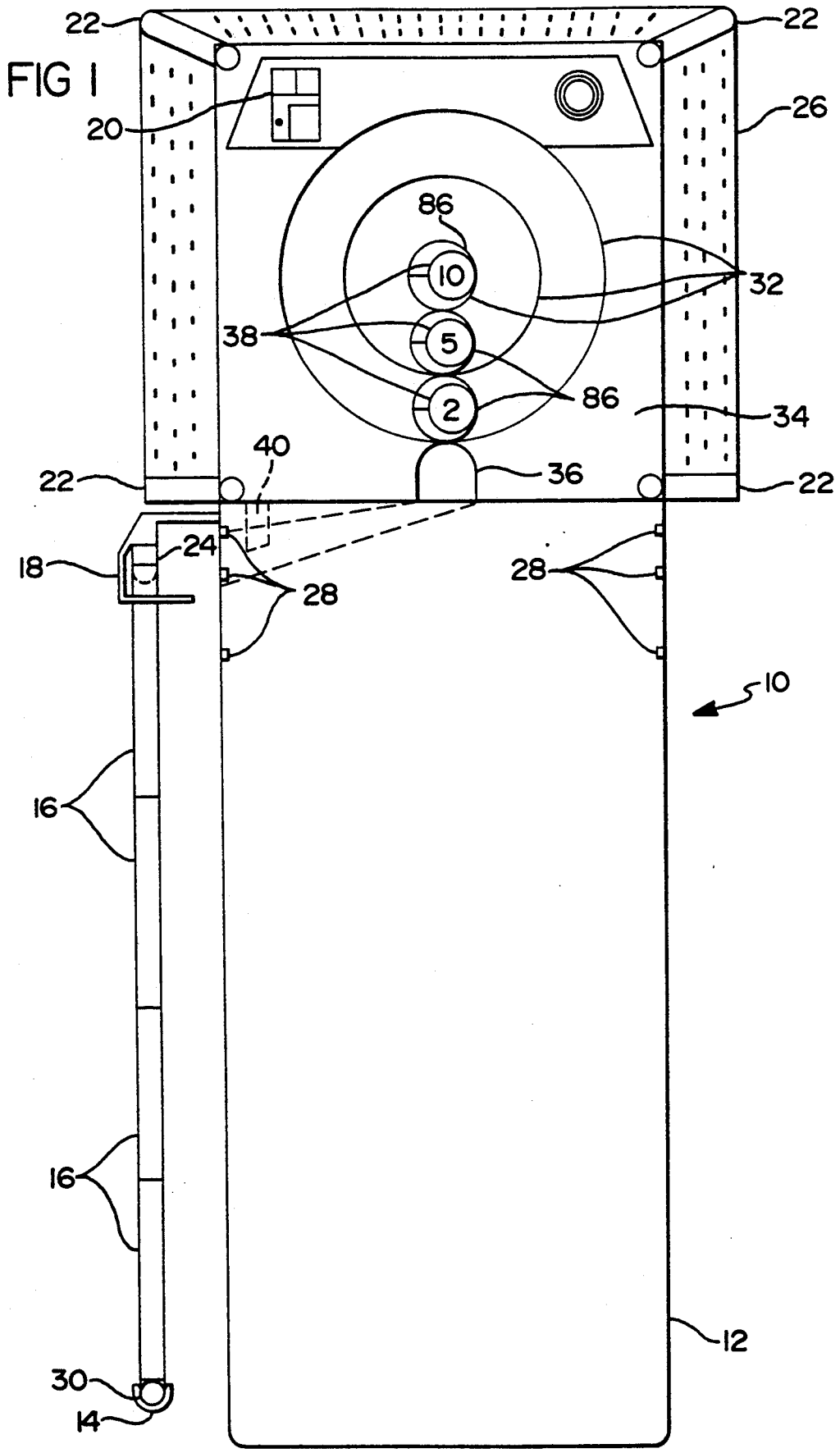
FIG. 1 is a top elevation of the invention 10.

FIG. 1 shows the invention 10 as utilized in a preferred embodiment. In playing of the game, a player rolls a ball 30 along the runner 12 which is operably engaged with the ramp 42, (shown in FIG. 2), and the runner holders 28. The ramp 42, shown in FIG. 2, curves upward and if the ball 30 is rolled with sufficient force it will become airborne, landing as is the object of the game, in one of the target rings 32 which are operably engaged with the target member 34. The target member 34 defines apertures 86 through which the ball 30 will pass if it lands within one of the target rings 32, striking the target strike sensors 38 which are operably engaged with the electrical circuit, not shown. The apertures 86 open into, the ball return chamber 52, shown in FIG. 2, which is operably engaged with the target member 34 and the first ball return track 36. Should the ball 30 fail to strike any of the target strike sensors 38, yet strike the target member 34, it will fall into the first ball return track 36 and contact the first ball return sensor 40 which is operably engaged with the electrical circuit, not shown, displaying a score on the optical display 20 which is operably engaged with the electrical circuit, not shown. A striking of the target strike sensors 38 will display an appropriate score upon the optical display 20 which is operably engaged with the electrical circuit, not shown, which is operably engaged with the target strike sensors 38. Contact of a ball 30 with either the target strike sensors 38 or the first ball return sensor 40 will elicit a sound from the speaker, not shown, which is operably engaged with the electrical circuit, not shown. The speaker, not shown; the electrical circuit, not shown; the target strike sensors 38; the first ball return track sensor 40, the optical display 20 and the power source, not shown, are operably engaged with one another by electrical wires, not shown, or other common connecting means known in the art. The first ball return track 36 is inclined toward the side of the target member 34 and said first ball return track 36 ends at the ball retainer 18, depositing the ball 30 within the ball retainer 18 and upon the second ball return track 16. After a ball 30 passes and contacts the first ball return sensor 40, electricity from the power source, not shown, is sent to the electrical motor, not shown, upon a command for said electricity being initiated by the electrical circuit, not shown, which is operably engaged with the power source, not shown, and the electrical motor, not shown. The motor, not shown, then turns the gears, not shown, which are operably engaged with the motor, not shown, and the power shaft, not shown, which is operably engaged with the ball retainer 18 which is also turns through operable engagement with the motor, not shown. This turning lifts the second joining member 24 which is pivotally and operably engaged with the ball retainer 18 by being connected in pivotal engagement by the pin 58. This turning action of the ball retainer 18 releases the ball 30 and the curved portion 88, shown in FIG. 2 and FIG. 3, of the ball retainer 18 additionally contacts and moves the ball 30 toward the ball stop 14, enhancing the momentum of the ball 30 along the second ball return track 16 which is at that time inclined due to the lifting of that portion of the second ball return track 16 which is connected to the second joining member 24. The net support posts 22 are shown in operable engagement with the net 26 and operably engaged with the depressions, not shown, defined by the target member 34, said depressions, not shown, being configured to retain the net support posts 22.

Figure 2:
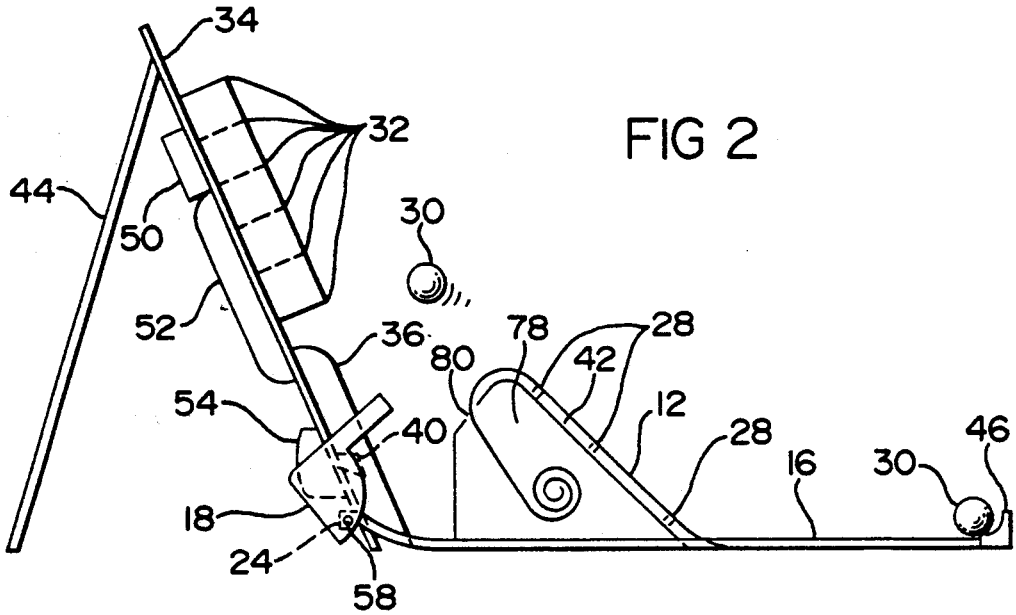
FIG. 2 is a side view of the invention 10.

FIG. 2 shows the runner 12 in operable engagement with the ramp 42 and the runner holders 28. Additionally, the runner 12 is shown displaced through the aperture defined upon the ramp 42 and further displaced within the depression defined by the ramp 42. The legs 44 are shown operably engaged with the target member 34 through their being retained within the depressions, not shown, defined by the target member 34 which are configured to receive them. The first housing 50, which conceals the power source, not shown, and the electrical circuit, not shown, is shown operably engaged with the target member 34. The ball return chamber 52 is shown operably engaged with the target member 34 and conceals the target strike sensors 38, not shown. Further detail is shown of the arcuately configured portion 88 of the ball retainer 18 and the ball stop 46.

Figure 3:
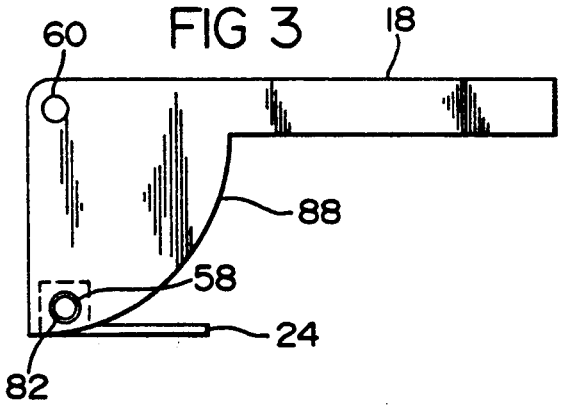
FIG. 3 is an enlarged side view of the ball retainer 18, the pin 58, the second joining member 24 and the end of the power shaft 60.

FIG. 3 shows additional detail of the ball retainer 18, the pin 58, the second joining member 24 and the end of the power shaft 60 which is operably engaged with the ball retainer 18.

Figure 4:
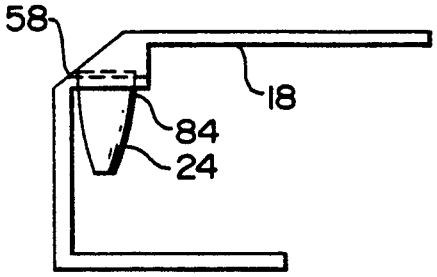
FIG. 4 is a top view of the ball retainer 18, the pin 58 and the second joining member 24.

FIG. 4 shows the substantially U-shaped configuration, when viewed from above, of the ball retainer 18. It additionally shows the elliptically shaped edges of the second joining member 24 which are configured to be retained within the second return track flanges 70.

Figure 5:
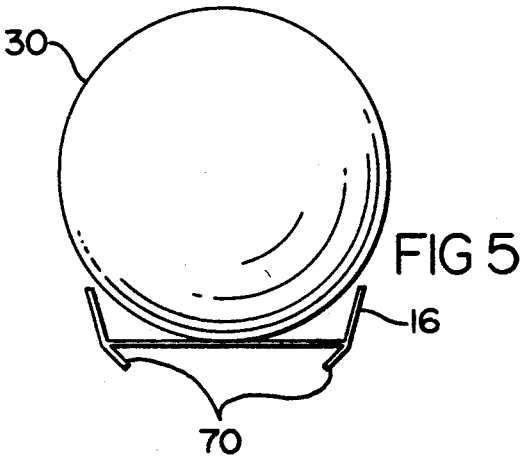
FIG. 5 is an end view of the second return track 16 and the second return track connector flanges with a ball 18 in position upon the second return track 16.

FIG. 5 shows the substantially H-shaped end view of the second ball return track 16 and additionally shows that the second ball return track flanges are angled slightly inward to compressively engage either the second connector member or the first joining member 72.

Figure 6:
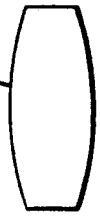
FIG. 6 is a top view of a first joining member 72.

FIG. 6 shows the elliptical configuration of the sides of the first joining member 72 which serves to permit easy insertion of the first joining member 72 within the second ball return track flanges 70.

The foregoing description of the preferred embodiment is not meant to limit the scope of the claimed invention which may be practiced in a variety of embodiments. Further, the claimed invention will be best understood from a reading of the appended claims.

I claim:

1. An improved portable version of the common Skee-Ball game the improvement comprising of, in combination:

(a) a target member having a plurality of apertures defined therein for a ball to pass through;
(b) at least one target ring operably engaged with the target member;
(c) a ball return chamber operably engaged with the target area and the target member;
(d) at least one supportive leg operably engaged with the target member;
(e) a ball restriction member operably engaged with the target member;
(f) more than one supporting post operably engaged with the ball restriction area and the target member;
(g) a ramp operably engaged with the target member;
(h) a runner operably engaged with the ramp;
(i) a first inclined ball return track operably engaged with the target member and the ball return chamber;

(j) at least one second ball return track member operably engaged with the target member;
(k) a first means for selectively lengthening the runner operably engaged with the ramp;
(l) a second means for audibly and optically announcing that the target member area has been struck by a ball, if any, operably engaged with the target member;
(m) a third means for selectively adjusting the length of the second ball return track operably engaged with the second ball return track;
(n) a fourth means for electronically sensing the presence of a ball in the first ball return track operably engaged with the first ball return track;
(o) a fifth means for retaining the ball at the junction of the first and second ball return tracks operably engaged with the target member;
(p) a sixth means for elevating the second ball return track and simultaneously releasing a ball retained by the fifth means operably engaged with the second ball return track;
(q) a seventh means for increasing a balls momentum along the second ball return track operably engaged with the second ball return track;
(r) an eighth means for audibly announcing the returning of a ball to the player(s) along the second ball return track operably engaged with the second ball return track;
(s) a ninth means for stopping the ball at the end of the second ball return track furthest from the seventh means operably engaged with the second ball return track;

2. The apparatus of claim 1, wherein the first means comprises, in combination:
(a) said ramp having a depression defined upon it;
(b) said ramp having an aperture defined therein;
(c) said runner is operably engaged with the ramp;
(d) said ramp defines projections upon at least one surface for holding the ramp and the runner in operable engagement; and
(d) said runner may be displaced within the depression and through the aperture defined by the ramp.

3. The apparatus of claim 2, wherein the second means comprises, in combination:
(a) at least one electronic target strike sensor operably engaged with the target member;
(b) an electronic circuit operably engaged with the target strike sensor(s);
(c) an electronic power source operably engaged with the electronic circuit;
(d) a electrically operated speaker operably engaged with the electronic circuit;
(e) a electrically operated optical display operably engaged with the electronic circuit; and
(f) said target strike sensor is displaced within the ball return chamber.

4. The apparatus of claim 3, wherein the third means comprises, in combination:
(a) at least one first joining member operably engaged with at least one second ball return track member; and
(b) said first joining members have two ends for operably engaging a second ball return track member.

5. The apparatus of claim 4, wherein the fourth means comprises, in combination:
(a) an electronic sensor operably engaged with the electronic circuit and the first ball return track.

6. The apparatus of claim 5, wherein the fifth means comprises, in combination:
(a) a ball retaining member operably engaged with the target member; and
(b) said ball retaining member is operably engaged with the sixth means.

7. The apparatus of claim 6, wherein the sixth means comprises, in combination:
(a) a motor operably engaged with the power source and the target member;
(b) at least two gears operably engaged with the motor;
(c) a power shaft is operably engaged with at least one gear and the ball retaining member;
(d) said ball retainer has an aperture defined therein;
(e) a pin is operably engaged with the aperture defined by the ball retainer;
(f) a second joining member which defines an aperture is operably and pivotally engaged with the pin;
(g) said gears rotate causing the ball retainer to rotate and release the ball; and
(h) said gears rotating the ball retainer elevates the pin and the second joining member which is operably engaged with at least one second return track member when power is supplied to the motor by the power source.

8. The apparatus of claim 7, wherein the seventh means comprises, in combination:
(a) a portion of the ball retaining member is of a substantially arcuate configuration and moves toward the ninth means during the action of the sixth means; and
(b) said ball retaining member contacts the ball and moves said ball toward the ninth means during the action of the sixth means.

9. The apparatus of claim 8, wherein the eighth means comprises, in combination:
(a) the fourth means operably engaged with the electronically operated speaker.

10. The apparatus of claim 9, wherein the ninth means comprises, in combination:
(a) a ball stop member operably engaged with the second ball return track at the end furthest from the ball retaining member.

11. The apparatus of claim 10, wherein:
(a) the second ball return track defines flanges upon one surface for operably and releasably engaging the joining members.

12. The apparatus of claim 11, further including, in combination:
(a) a first housing defining a depression operably engaged with the target area, the power source and the electrical circuit;
(b) a second housing defining a depression operably engaged with the target area, the power shaft, the motor and the gears;
(c) said first housing is configured to receive the power source and the electrical circuit within the depression defined therein; and
(d) said second housing is configured to receive the motor, the gears and the power shaft within the depression defined therein.

13. The apparatus of claim 12, wherein:
(a) said ball restriction member is operably engaged with the outer parameter of the target member.

14. The apparatus of claim 13, wherein:
(a) said ball restriction member is a net of flexible material.

* * * * *